US008910402B2

(12) United States Patent
Mischel, Jr. et al.

(10) Patent No.: US 8,910,402 B2
(45) Date of Patent: Dec. 16, 2014

(54) MEDICINE CABINET ASSEMBLY

(75) Inventors: James V. Mischel, Jr., Seattle, WA (US); James V. Mischel, Sr., Lynnwood, WA (US); Patrick Daniel Erickson, Seattle, WA (US)

(73) Assignee: Electric Mirror, LLC, Everett, WA (US)

( * ) Notice: Subject to any disclaimer, the term of this patent is extended or adjusted under 35 U.S.C. 154(b) by 790 days.

(21) Appl. No.: 12/383,624

(22) Filed: Mar. 27, 2009

(65) Prior Publication Data

US 2009/0225519 A1 Sep. 10, 2009

Related U.S. Application Data

(63) Continuation-in-part of application No. 11/563,119, filed on Nov. 24, 2006.

(60) Provisional application No. 61/040,586, filed on Mar. 28, 2008, provisional application No. 60/794,209, filed on Apr. 21, 2006, provisional application No. 60/739,399, filed on Nov. 23, 2005, provisional application No. 60/739,156, filed on Nov. 23, 2005.

(51) Int. Cl.

| | |
|---|---|
| ***G09F 13/00*** | (2006.01) |
| ***G09F 9/00*** | (2006.01) |
| ***G09F 19/14*** | (2006.01) |
| *G09F 13/12* | (2006.01) |

(52) U.S. Cl.

CPC . *G09F 9/00* (2013.01); *G09F 13/00* (2013.01); *G09F 13/12* (2013.01); *G09F 19/14* (2013.01)

USPC ..... 40/219; 40/541; 362/128; 362/135; 359/839; 312/227

(58) Field of Classification Search

CPC ..... G09F 13/12; G09F 13/00

USPC ..... 40/541, 219; 362/128, 135; 359/839; 312/227

See application file for complete search history.

(56) References Cited

U.S. PATENT DOCUMENTS

| | | | | |
|---|---|---|---|---|
| 3,244,464 | A * | 4/1966 | McMurtrie et al. | 312/227 |
| 4,747,223 | A * | 5/1988 | Borda | 40/219 |
| 4,803,602 | A * | 2/1989 | Svensson | 362/135 |
| 7,551,354 | B2 * | 6/2009 | Horsten et al. | 359/485.07 |
| 7,589,893 | B2 * | 9/2009 | Rottcher | 359/443 |
| 2002/0196333 | A1 * | 12/2002 | Gorischek | 348/61 |
| 2007/0013278 | A1 * | 1/2007 | Herber | 312/227 |

FOREIGN PATENT DOCUMENTS

| | | | | |
|---|---|---|---|---|
| JP | 06062938 A | * | 3/1994 | 362/135 |

* cited by examiner

*Primary Examiner* — Syed A Islam

(74) *Attorney, Agent, or Firm* — Peloquin, PLLC; Mark S. Peloquin, Esq.

(57) ABSTRACT

An apparatus includes a first mirror platform; the first mirror platform has a first portion and a second portion. A media display device is disposed behind the first mirror platform, such that within the second portion information displayed on the media display device is visible when the media display device is on and is viewed from in front of the first mirror platform. A mounting platform is coupled to a back of the first mirror platform to form a door assembly and the mounting platform can also be a mirror platform.

35 Claims, 8 Drawing Sheets

MEDICINE CABINET ASSEMBLY

RELATED APPLICATIONS

This patent application claims priority from commonly assigned U.S. Provisional Patent Application Ser. No. 61/040,586 filed on Mar. 28, 2008, This patent application is a continuation-in-part of commonly assigned U.S. patent application Ser. No. 11/563,119, filed on Nov. 24, 2006, which claims the benefit of U.S. Provisional Patent Application No. 60/739,156, filed on Nov. 23, 2005; U.S. patent application Ser. No. 11/563,119 claims the benefit of U.S. Provisional Patent Application No. 60/739,399, filed on Nov. 23, 2005; and U.S. patent application Ser. No. 11/563,119 claims the benefit of U.S. Provisional Patent Application No. 60/794,209, filed on Apr. 21, 2006.

U.S. Provisional Patent Application Ser. No. 61/040,586 filed on Mar. 28, 2008, is hereby incorporated by reference into the present application. U.S. patent application Ser. No. 11/563,119, filed on Nov. 24, 2006; U.S. Provisional Patent Application No. 60/739,156, filed Nov. 23, 2005; U.S. Provisional Patent Application No. 60/739,399, filed on Nov. 23, 2005; and U.S. Provisional Patent Application No. 60/794,209, filed on Apr. 21, 2006 are hereby incorporated by reference into the present application.

BACKGROUND OF THE INVENTION

1. Field of Invention

The invention relates generally to medicine cabinet assemblies, and more specifically to lighting and media display systems.

2. Art Background

In today's fast-paced world, people often have a television in their bathroom so that they may watch the news or other television shows while they are getting ready in the morning, cleaning up at night, etc. Currently available mirror and television devices typically include a television mounted to the back of a mirror. This arrangement is a convenient, space-saving device, as it embeds a television in the existing space occupied by a mirror. Although the mirror/television assembly conserves space in most bathrooms, very small bathrooms often require a mirrored medicine cabinet for extra storage space. Thus, a television cannot be secured behind the mirror without interfering with the storage area in the medicine cabinet. This may present a problem. Moreover, if the ceiling in a bathroom is low, the medicine cabinet must often be decreased in size to allow for a suitable light fixture to be secured above the medicine cabinet. This may present a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described, which provide an integration of lighting and media display within a part of a medicine cabinet. Within this description of embodiments, the terms "invention" and "present invention" are synonymous with "present disclosure."

Figure 1:
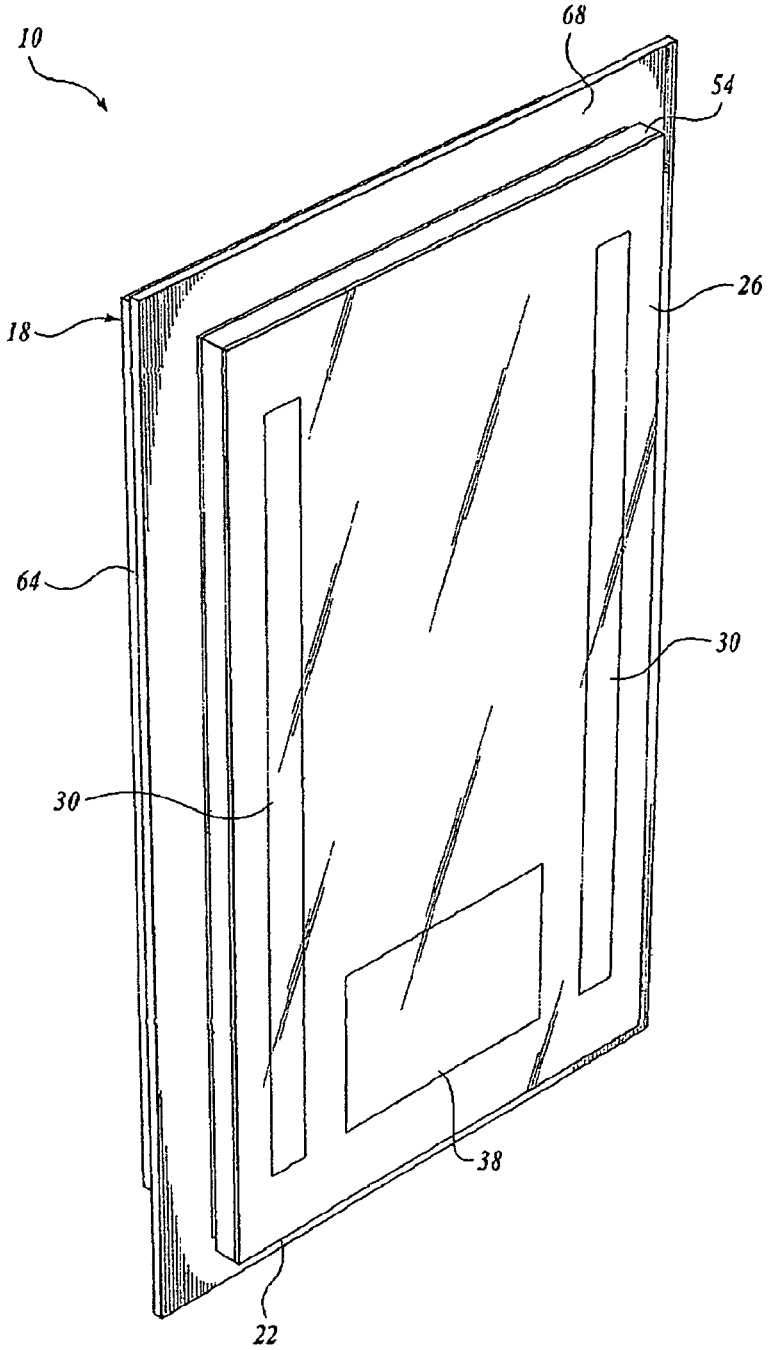
FIG. 1 is an isometric view of a medicine cabinet assembly constructed in accordance with one embodiment of the present disclosure.
Figure 2:
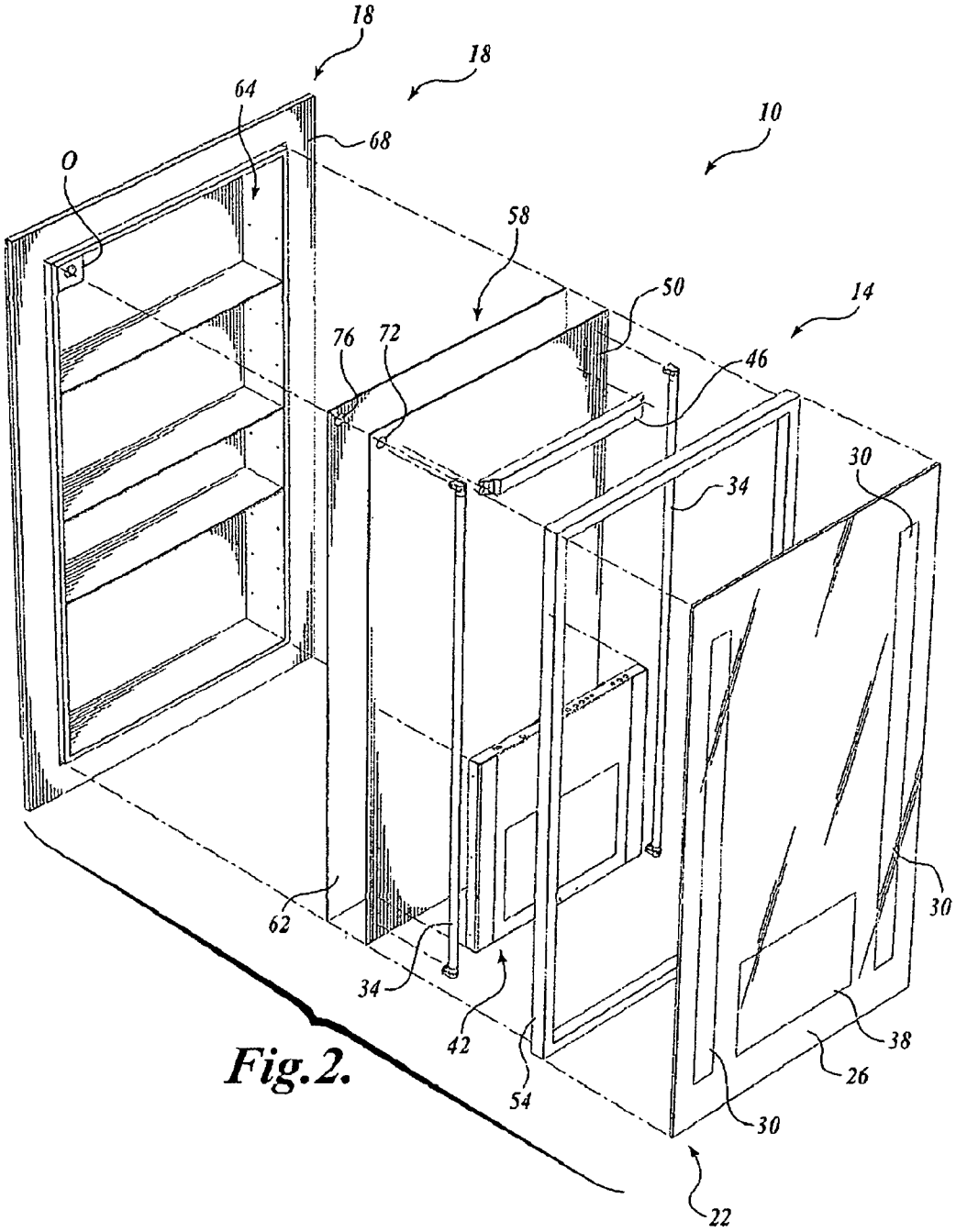
FIG. 2 is an exploded view of the medicine cabinet of FIG. 1.

A medicine cabinet assembly 10, constructed in accordance with one embodiment of the present disclosure, is best understood by referring to FIGS. 1 and 2. The medicine cabinet assembly 10 includes a door assembly 14 hingedly connected to a cabinet 18. The door assembly 14 includes a framed or frameless first mirror platform 22 having a first substantially reflective surface 26 on a first side of the mirror platform 22 and a first non-reflective surface (not shown) on a second side of the mirror platform 22. It will be noted by those of skill in the art that the first mirror platform 22, as described herein, is made with a layer of glass and that a first substantially reflective surface 26 can be applied to either side of the layer of glass.

The first mirror platform 22 further includes one or more translucent backlit portions 30 that have substantially no reflectivity (e.g., frosted glass, acid etched glass, or clear glass). The backlit portions 30 are translucent, allowing light emitted from one or more light sources 34 disposed within the door assembly 14 to pass through the first mirror platform 22. The number, configuration, and arrangement of backlit portions 30 can be varied to achieve different lighting effects. As a non-limiting example, the backlit portion 30 may be configured as two parallel, substantially straight portions formed along each side of the first mirror platform 22 or, instead, as a single, continuous portion extending around the perimeter of the first mirror platform 22.

The first mirror platform 22 further includes a media display device viewing portion 38 through which a media display device 42 located behind the first mirror platform 22 can be viewed. The media display device viewing portion 38 is both reflective and transmissive. Any suitable mirror technology may be used to allow the media display device viewing portion 38 to operate at maximum reflectivity when the media display device 42 is turned off, and to allow light from the media display device 42 to be transmitted therethrough when the media display device 42 is turned on. More specifically, the reflectivity of the media display device viewing portion 38 closely matches the rest of the first reflective surface 26 when the media display device 42 is turned off, causing the media display device viewing portion 38 to blend in with the rest of the first reflective surface 26. However, the user can view the images on the media display device 42 when the media display device 42 is turned on. In another embodiment, the media display device viewing portion 38 blends with the first reflective surface 26, and appears black when the media display device is turned off. In another embodiment, the media display device viewing portion 38 blends with the first reflective surface 26 rendering the media display device viewing portion 38 partially reflective when the media display device is turned off.

The media display device 42, light sources 34, and any other electrical components, such as an electrical ballast 46, are positioned behind the first mirror platform 22 and secured to a mounting platform 50 substantially identical in shape and size to the first mirror platform 22. Alternatively, the electrical ballast 46 can be located in or behind the cabinet 18. The mounting platform 50 is formed from a suitable material, such as wood, metal, plastic, etc. to allow the electrical components to be mounted directly thereto. Preferably, each light source 34 is mounted to the mounting platform 50 such that it is positioned directly behind each translucent backlit portion 30. Alternatively, the light sources 34 can be mounted such that they are offset from portion 30; thus, in such an embodiment, the light sources 34 are not directly behind portion 30. Moreover, the media display device 42 is positioned on the mounting platform 50 such that the screen of the media display device 42 aligns with the media display device viewing portion 38 of the first mirror platform 22. In one embodiment, the mounting platform 50 can be a mirror platform itself or include a mirror platform, thereby providing a mirrored surface on either side of the door assembly 14.

Any suitable electrical components may be used. For instance, the light source 34 may be a fluorescent lamp, a light-emitting diode (LED) strip assembly, light emitting film, etc. Moreover, a media display device 42 may be any media display device suitable for receiving television signals, computer signals, VGA connections, digital signals, etc., and displaying a corresponding image. In various embodiments, the media display device can be constructed using a liquid crystal display (LCD), an organic light emitting diode (OLED), or other flat display technology. In one embodiment a media display device 42 is located within a door assembly 14. In another embodiment, a display screen of a media display device is located within the door assembly 14 behind the first mirror platform 22 and the rest of the media display electronics, such as for example, TV tuner, power supply, etc., are separate from the display screen and are located within the interior chassis 54 of the door assembly 14. In yet another embodiment, a display screen of a media display device is located within the door assembly 14, and the rest of the media display electronics, such as for example, TV tuner, power supply, etc., are outside of the door assembly 14, located in or behind the cabinet 18.

In one embodiment, to form a portion of the door assembly 14, the first mirror platform 22 and mounting platform 50 are each secured to opposite sides of an interior chassis or frame 54 with the first reflective surface 26 of the first mirror platform 22 facing away from the chassis 54. Preferably, interior chassis or frame 54 is substantially identical in shape and size to both the first mirror platform 22 and the mounting platform 50 such that the exterior edges of the interior chassis 54, the first mirror platform 22, and the mounting platform 50 are substantially flush with each other. The interior chassis 54 includes a substantially large opening to house the electrical components disposed between the mounting platform 50 and the first mirror platform 22. The first mirror platform 22 and the mounting platform 50 are secured to the interior chassis 54 in any suitable manner, such as with fasteners or with an adhesive. In another embodiment, the mounting platform 50 provides the functionality of the interior chassis 54; thereby eliminating the need for a separate interior chassis.

In one embodiment, to complete the door assembly 14, a second mirror platform 58 is secured to the back side of the mounting platform 50 opposite the electrical components. The second mirror platform 58 includes a second reflective surface (not shown) formed on one side of the second mirror platform 58 and a second non-reflective surface 62 formed on the opposite side of the second mirror platform 58. The second mirror platform 58 is secured to the back side of the mounting platform 50 with the second non-reflective surface 62 adjacent to the back side of the mounting platform 50. Note that the second reflective surface can be formed on either side of the second mirror platform 58.

The door assembly 14 is hingedly connected to the cabinet 18 in any suitable manner well known in the art, allowing the door assembly 14 to be moved between open and closed positions. For instance, piano hinges, scissor-style hinges, or any other suitable hinges (not shown) may be used. The door assembly 14 includes a first reflective surface 26 on the front of the door assembly 14 and a second reflective surface formed on the back of the door assembly 14. Thus, a reflective surface is provided for the user when the door assembly 14 is in either the open or closed position.

The cabinet 18 may be of any suitable design well known in the art, such as a surface mount cabinet or a recessed cabinet. The cabinet 18 preferably includes a storage portion 64 having a plurality of shelves disposed therein for storing items thereon such as medicine bottles, toiletries, hair products, etc. The cabinet 18 may further include a frame 68 disposed around the exterior of the storage portion 64. In one embodiment, the frame 68 may be substantially similar in shape to the door assembly 14 yet larger in size such that the frame 68 is visible behind the door assembly 14 when the door assembly 14 is in the closed position. In another embodiment, the frame 68 is not visible behind the door assembly 14 when the door assembly 14 is in the closed position.

Preferably, the storage portion 64 includes an opening sized to receive an electrical outlet O therein. Moreover, the mounting platform 50 and the second mirror platform 58 preferably include first and second aligned openings 72 and 76 that define an electrical passageway for routing electrical cabling and wiring of the electrical components therethrough. Preferably, first and second openings 72 and 76 are positioned on the mounting platform 50 and the second mirror platform 58 such that are substantially aligned with the opening defined in the storage portion 64 for the electrical outlet O. As such, the electrical components of the medicine cabinet assembly 10 may be easily placed into communication with the electrical outlet O. Moreover, the first and second openings 72 and 76 are preferably formed near the edges of the mounting platform 50 and second mirror platform 58 adjacent the hinge (not shown) of the door assembly 14 such that the electrical cabling and wiring does not interfere with the opening of the door assembly 14.

Figure 3:
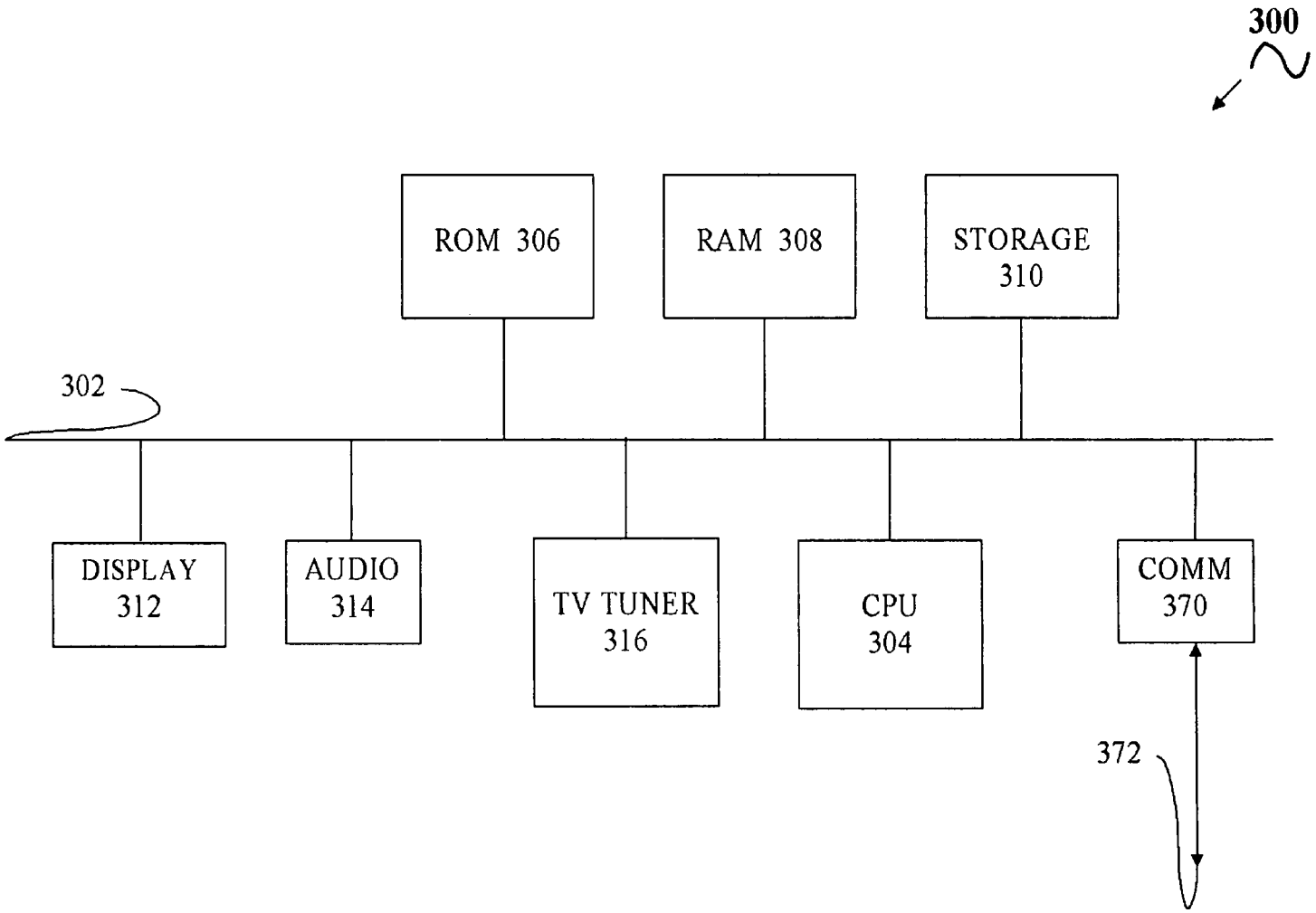
FIG. 3 illustrates a block diagram of a media display device.

FIG. 3 illustrates, generally at 300, a block diagram of a media display device in which computer signals can be displayed according to various embodiments of the invention. The block diagram is a high-level conceptual representation and may be implemented in a variety of ways and by various architectures. With reference to FIG. 3, a bus system 302 interconnects a Central Processing Unit (CPU) 304, Read Only Memory (ROM) 306, Random Access Memory (RAM) 308, storage 310, display 312, audio 314, television (TV) tuner 316, and communications 370. In various embodiments, the display 312 can be configured as a touch screen or a non-touch screen. The bus system 302 may be for example, one or more of such buses as a system bus, Peripheral Component Interconnect (PCI), Advanced Graphics Port (AGP), Small Computer System Interface (SCSI), Institute of Electrical and Electronics Engineers (IEEE) standard number 1394 (FireWire), Universal Serial Bus (USB), or a dedicated bus designed for a custom application, etc. The CPU 304 may be a single, multiple, or even a distributed computing resource. Storage 310 may be Compact Disc (CD), Digital Versatile Disk (DVD), hard disks (HD), optical disks, tape, flash, memory sticks, video recorders, etc. Note that depending upon the actual implementation of a media display device, the media display device may include some, all, more, or a rearrangement of components in the block diagram.

Connection with a network, such as an intranet or the Internet is obtained via 372 and communication 370, as is recognized by those of skill in the art, which enables the media display device 300 to communicate with other data processing devices in remote locations as well as to receive and display television broadcasts with the TV tuner 316. Communication 370 can provide wireless connectivity utilizing protocols such as IEEE 802.11b, 802.11a, 802.11g, 802.11n as well as protocols not yet developed. Alternatively, communications 370 can provide a hardwire connection.

The media display device 300 can be configured as a desktop computer, work station, or with a remote slim profile form factor for mounting in or behind a medicine cabinet. The media display device 300 can be configured to run for example a WINDOWS® compatible operating systems such as WINDOWS® XP Home or WINDOWS® XP, WINDOWS® XP Professional, WINDOWS® VISTA Professional Linux, etc. or the media display device 300 can be implemented with a computer from APPLE COMPUTER, Inc. running operating systems such as OS X, etc.

In certain applications where it is desired to minimize volume, a display 312 can be mounted in a door assembly of a cabinet (such as in the door assembly 14 of the cabinet 18 in FIG. 2) and the rest of components shown in FIG. 3 can be mounted in or behind the cabinet 18 (FIG. 2). Audio 314 can be included in a door assembly or it can be incorporated into a cabinet, such as cabinet 18 (FIG. 2). Audio 18 is used to provide sound to the user of the media display device 300.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the embodiments. It will be evident, however, to one of ordinary skill in the art that the embodiments may be practiced without these specific details. In some instances, well-known structures and devices are shown in block diagram form, rather than in detail, in order to avoid obscuring the embodiments. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

Figure 4:
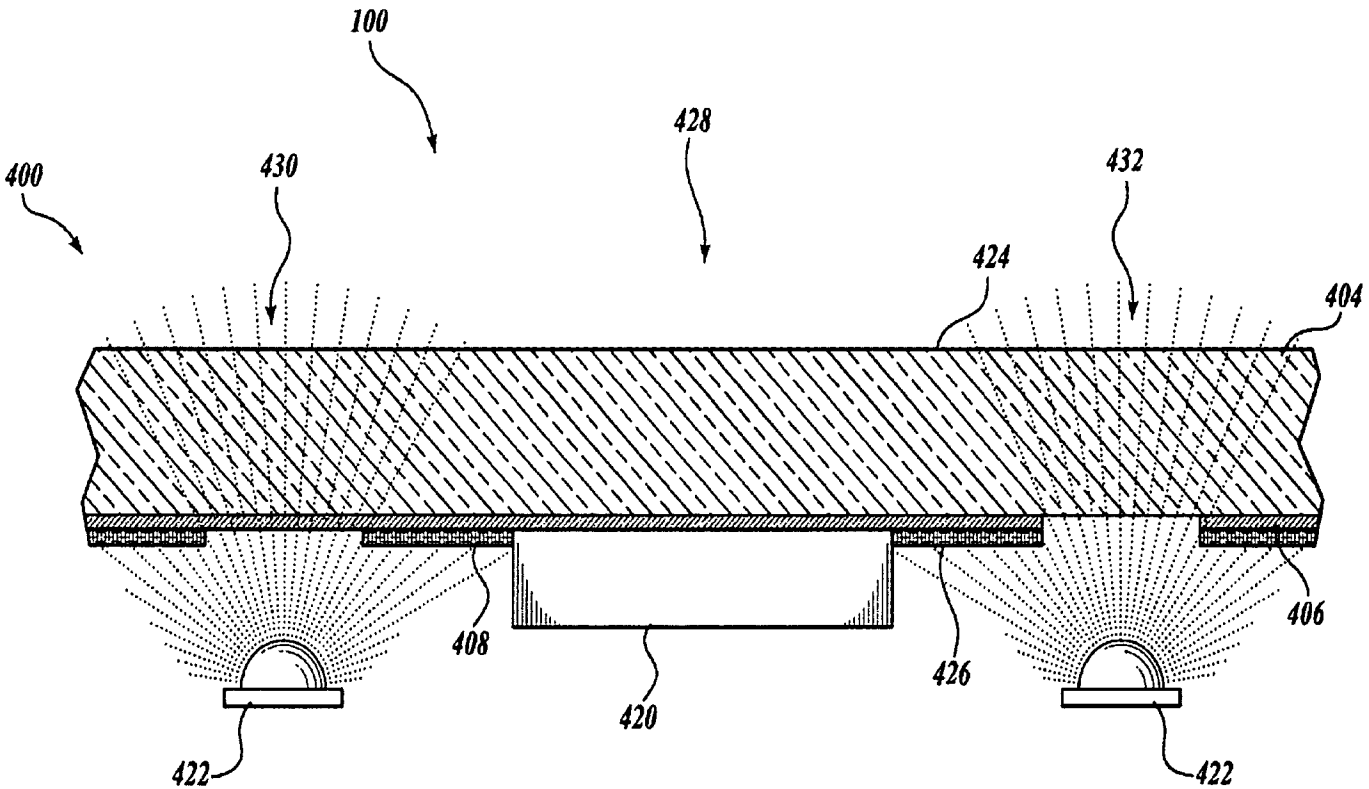
FIG. 4 is a cross-sectional view of the mirror/media display device assembly of FIG. 6 constructed in accordance with a first embodiment of the present disclosure.

FIG. 4 illustrates a mirror/media display device assembly 100 having a mirror platform 400 constructed in accordance with one embodiment of the present disclosure. The mirror platform 400 includes a glass layer 404, a reflective layer 406, and backing layer 408. For ease of description and clarity, such a mirror platform 400 is referred to as a "transmissivemirror."

The transmissive mirror includes a front surface 424 and a rear surface 426. The reflective layer 406 provides a partial reflectivity to the transmissive mirror and is suitably formed by a reflective film, a sputter coating, or any other type of suitable reflective material. The reflective layer 406 is both reflective and transmissive. While the reflective layer 406 is shown on the rear surface 426 of the transmissive mirror, it can also be located on the front surface 424 or both the front and rear surfaces 424 and 426 of the transmissive mirror. The transmissive mirror is partially transmissive, preferably having a transmissivity of about 50%, although mirrors having transmissivity between about 30% and about 70% are within the scope of this embodiment.

Still referring to FIG. 4, the backing layer 408 is selectively disposed on the rear surface 426 of the transmissive mirror. The backing layer 408 increases the reflectivity of the mirror platform 400 in areas to which it is applied. Because of the increased reflectivity, these areas provide a better reflection, which is closer to that of a standard mirror, than do the portions of the transmissive mirror to which the reflective backing is not applied.

The backing layer 408 is not applied to the transmissive mirror in the media display device viewing area 428. As a result, while the media display device viewing area 428 has some reflectivity due to the reflectivity of the transmissive mirror, the media display device viewing area 428 has less reflectivity than the areas of the transmissive mirrorto which the backing layer 408 has been applied. The reduced reflectivity in the media display device viewing area 428 causes less glare and consequently results in a clearer view of the images displayed on the media display device.

It should be appreciated, however, that when the media display device 420 is turned off, the substantially black media display device screen located behind the media display device viewing area 428 will change the light ratio between the front and back of the mirror; thereby, allowing transmissive mirror to operate at its maximum reflectivity. Accordingly, the reflection from the media display device viewing area 428 will more closely match that of the rest of the transmissive mirror, causing the media display device viewing area 428 to blend in with the rest of the transmissive mirror.

The backing layer 408 is suitably formed from a reflective film, sputter coating, silvering, or any other material that enhances reflectivity when applied to a surface 426. Depending on the material used, a variety of suitable techniques can be used to selectively apply the reflective backing, including masking areas in which the reflective backing is not to be applied, using computer controlled applicators, or applying the backing to the entire transmissive mirror and then selectively removing it.

The transmissive mirror also includes first and second back lit portions 430 and 432. The back lit portions 430 and 432 are suitably formed on the transmissive mirror by different methods. As previously described, the back lit portions are at least partially translucent, having lower reflectivity and/or higher transmissivity than the rest of the transmissive mirror. Accordingly, back lit portions 430, 432 can be formed by decreasing the reflectivity of the back lit portion relative to the rest of the transmissivemirror.

A first back lit portion 430 formed on the mirror platform 400 is similar in construction to the media display device viewing area 428. The first back lit portion 430 is defined by an area where the backing layer 408 is not present. As previously discussed with regard to the media display device viewing area, the first back lit portion 430 can be formed by the selective application of the backing layer 408, during which the backing layer 408 is not applied to the first back lit portion, or the selective removal of the reflective backing after it has been applied to the first back lit portion. The backing layer 408 may be removed from the first back lit portion by any suitable method, including acid etching, and an acid dip prior to which areas of the reflective backing that are to remain are masked. A film simulating a "frosted" effect may be placed on the backside of reflective layer 406.

When light from a light source 422 is irradiated on the rear surface of the mirror platform 400, the portions of the transmissive mirror to which the backing layer 408 has been applied to reflect the light back from the rear surface 426 of the transmissive mirror and consequently, substantially none of the light passes through the transmissive mirror to illuminate the front surface 424 mirror platform 400. In contrast, when light from the light source 422 strikes a portion of the transmissive mirror without backing layer 408, at least part of the light travels through the transmissive mirror, thereby illuminating the back lit portion 430 of the mirror platform 400. When the light source 422 is in an "off" state, the back lit portion 430 reverts back to having the reflectivity of a standard mirror.

A second back lit portion 432 is provided on the mirror platform 400. The second back lit portion 432 is similar to the first back lit portion 430 except that, in addition to the backing layer 408, some or all of the reflective layer 406 of the transmissive mirror is also removed in the area of the second back lit portion 432. Consequently, when light from the light source 422 is irradiated onto the rear surface 426 of the mirror platform 400 at a second back lit portion 432, at least some of the light is transmitted through the transmissive mirror to illuminate the front surface of the mirror platform 400 at the second back lit portion 432.

Further, because at least some of the reflective layer 406 of the transmissive mirror has been removed, a greater percentage of light from the light source 422 will pass through the second back lit portion 432 than will pass through the first back lit portion 430. It should be appreciated that any suitable number of back lit portions, such as three, four, five, six, etc., can be formed on the platform assembly 400 and, therefore, are also within the scope of the present disclosure.

The reflective layer 406 and the backing layer 408 may be removed from the second back lit portion by any suitable method, including sand blasting, acid etching, and an acid dip. Areas of the reflective layer 406 and backing layer 408 that are to remain are masked prior to removal treatment. Sandblasting, is particularly effective for providing a "frosted" effect in the back lit portion 432. A protective coating may be applied to the sand blasted areas of the glass to allow the sand blasted areas to be more easily cleaned and prohibit staining from finger prints, dirt, etc. This could occur for sand blasting on the front or back surface of the mirror.

In addition, the resist used to mask off the mirror for sandblasting may also be used as a safety back material. Typically, the resist is removed from the mirror after it has been sand blasted. In this case the resist would be left on and act as a safety backing. The resist may be laid on the back of the mirror and cut by a laser or other method or may be plotted and then placed on the back of the mirror.

Figure 5:
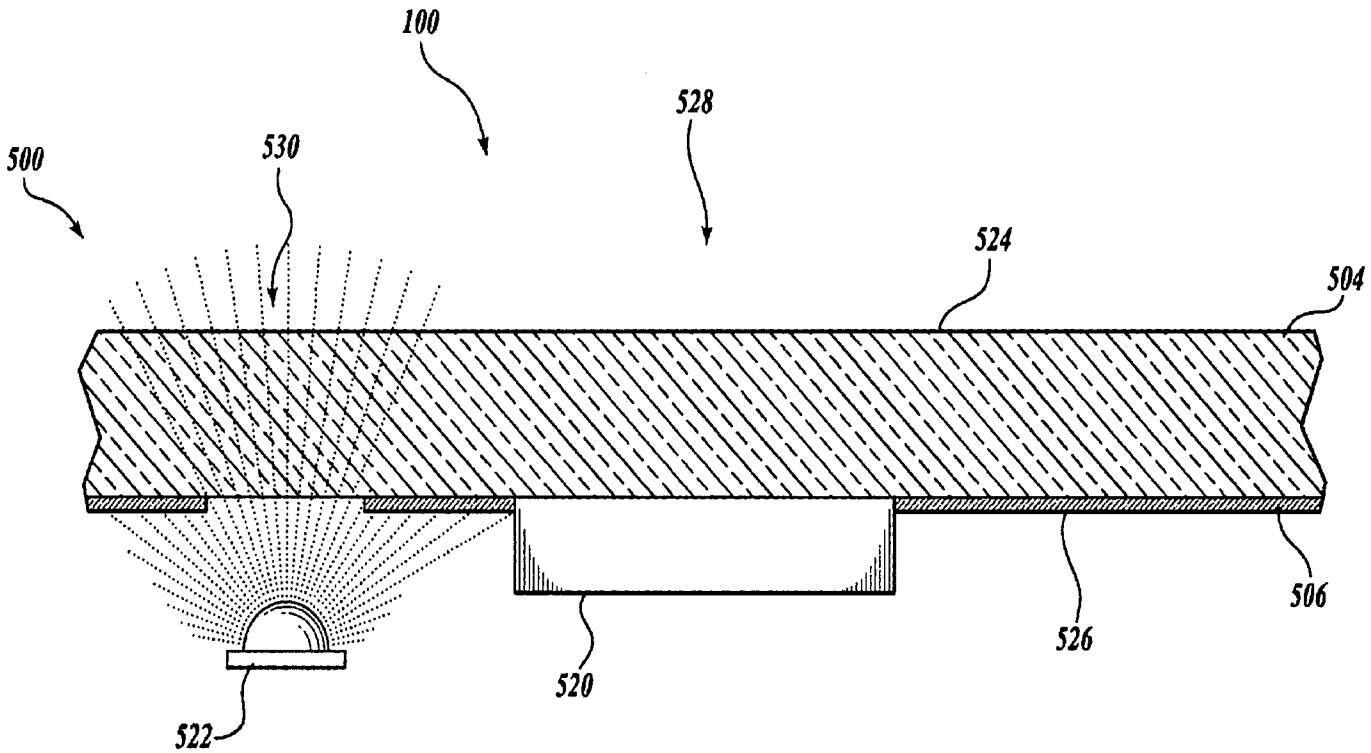
FIG. 5 is a cross-sectional view of a mirror/media display device assembly constructed in accordance with a second embodiment of the present disclosure.
Figure 6:
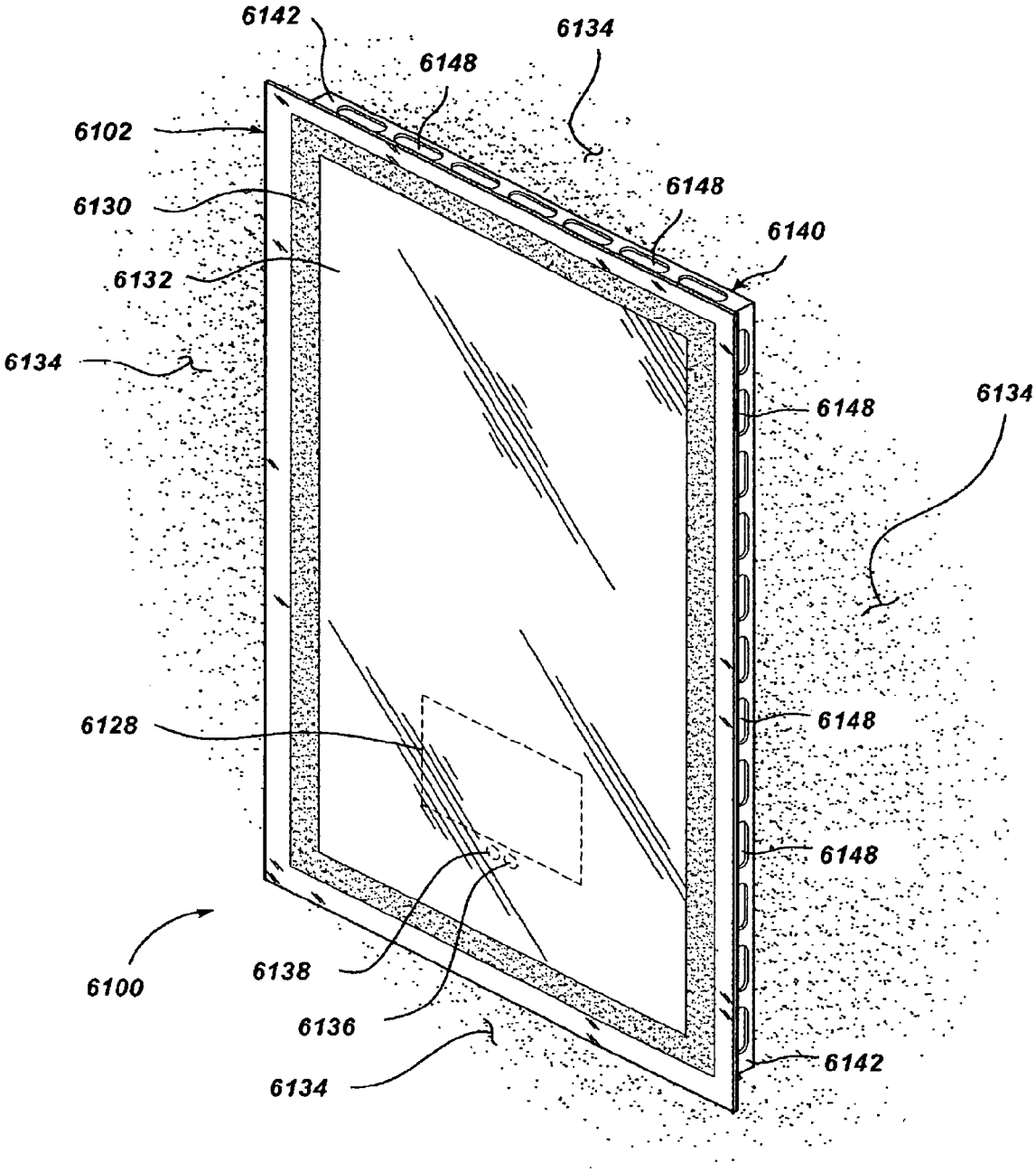
FIG. 6 is an isometric view of a representative mirror/media display device assembly constructed in accordance with one embodiment of the present disclosure.

Areas of the backing layer 408 and/or the reflective layer 406 of the transmissive mirror can also be selectively removed to provide areas of lower reflectivity to accommodate an indicator light 136 or an infrared sensor 138 (see FIG. 4-6).

FIG. 5 illustrates a mirror/media display device assembly 100 having a mirror platform 500 constructed in accordance with a second embodiment of the present disclosure. The mirror platform 500 is substantially identical in construction, material and operation as the mirror platform 400 described above with the following exceptions.

The mirror platform 500 includes a glass layer 504 and a backing layer 506, and also includes a front surface 524 and a rear surface 526. The rear surface 526 of the backing layer 506 is typically painted with a protective paint. For ease of description and clarity, the mirror platform 500 is referred to as a "standard mirror."

The standard mirror provides substantially no transmissivity, while reflecting almost all incident light. Commercially available standard mirrors, which are suitable for use with this embodiment, typically have a reflectivity of about 98%, which provides a very good reflection in the mirror portion of the mirror platform 500. However, it should be appreciated that a mirror having a lower reflectivity than a standard mirror can be used within the scope of this embodiment. Further, while a standard mirror usually has a backing layer 506 located on the rear, surface 526 of the mirror, a standard mirror with a reflective material located on the front surface 524 of the mirror can also be used.

The mirror platform 500 also includes a media display device viewing area 528. The media display device viewing area 528 is formed by an area that has been made non-reflective by selectively removing the backing layer 506 from the glass layer 504. A preferred method for selectively removing the reflective backing includes isolating the area by applying tape, printed ink or a similar item to the back of the standard mirror around the area from which the reflective backing is to be removed. Paint remover or a similar solvent is then applied to the rear surface 526, and paint is removed with a scraping device such as a razor blade.

The area is then washed with water or other suitable material to remove the paint and expose the backing layer 506 of the standard mirror. A sharp instrument is used to define the outer perimeter of the media display device viewing area 528, and an etching solution, such as Ferric chloride (FEC13), printed circuit board etching solution, or a similar material is applied to the exposed backing layer 506. After the solution sits for a suitable length of time, the solution is wiped away, which removes the backing layer 506, leaving only the glass layer 504. In an alternative embodiment, the media display device viewing area 528 is masked off on a piece of glass, and backing layer 506 is added to the glass layer 504.

After the backing layer 506 has been removed, the media display device viewing area 528 is close to 100% transmissive. Accordingly, when the media display device 520 is aligned with the media display device viewing area 528, the light from the media display device is transmitted through the glass layer 504 with minimal loss, making the images on the media display device screen readily visible from the front of the mirror platform 500.

In addition to the media display device viewing area 528, the backing layer 506 can also be removed from locations on the mirror platform 500 corresponding to an indicator light 136 or an infrared sensor 138 (see FIG. 4-6).

A back lit portion 530 of the mirror platform 500 allows light from a light source 522 located behind the rear surface 526 to pass through to illuminate a portion of the front surface 524 of the mirror platform 500. Back lit portions 530 are at least partially translucent and can be formed using the same processes employed to create the media display device viewing area 528. Alternately, sand blasting, chemical etching, dipping in a chemical bath, or treatment in any other manner previously disclosed, are also within the scope of the present disclosure to form back lit portions. A clear backing film may be added to the back side of the mirror to create safety mirror while at the same time allowing for light and display image to shine through.

A mirror/media display device assembly 6100 constructed in accordance with one embodiment of the present disclosure may be best understood by referring to FIGS. 6 4-4. The mirror/media display device assembly 6100 includes a framed or frameless mirror platform 6102 attached to a chassis 6140. The mirror platform 6102 includes a substantially reflective surface 6132, one or more translucent back lit portions 6130, and a media display device viewing portion 6128, through which a media display device 6120 located behind the mirror platform 6102 can be viewed. The chassis 6140 includes edge sections 6142 arranged to form a perimeter (i.e., periphery) of the chassis 6140. The edge sections 6142 include one or more apertures 6148. Although the chassis 6140 is described as including apertures 6148, it should be apparent that chassis 6140 without apertures 6148 are also within the scope of the present disclosure. Light emanating from the assembly 6100 is illustrated schematically by reference numeral 6134.

The one or more back lit portions 6130 located on the mirror platform 6102 have substantially no reflectivity (e.g., frosted glass, acid etched glass or clear glass). These back lit portions 6130 are translucent, allowing light emitted from one or more light sources 6122 disposed within the mirror/media display device assembly 6100 to pass through the mirror platform 6102. The number, configuration, and arrangement of back lit portions 6130 can be varied to achieve different lighting effects. As a non-limiting example, the back lit portion 6130 is configured as a single, continuous portion extending around the perimeter of the mirror platform 6102.

Light radiated from the light source 6122 radiates through the plurality of apertures 6148 to illuminate the surroundings of the mirror/media display device assembly 6100. Illuminating the surroundings, such as the wall on which the mirror/media display device assembly 6100 is mounted, creates a back lighting effect. The number and location of the apertures can be varied to achieve the desired visual atmosphere. For example, each side of the chassis includes a single aperture that extends along the length of the side of the chassis. In another embodiment, the chassis includes a single aperture that extends along the length of the lower edge of the chassis, illuminating a sink or countertop above which the mirror/media display device assembly 6100 is mounted.

The apertures 6148 of the chassis 6140 can be optionally covered by a transparent or translucent material (e.g., a plastic strip). In addition to helping to prevent dirt and moisture from entering the mirror/media display device assembly 6100, the material can be colored so that light radiated through the apertures 6148 creates a desired visual effect.

In another embodiment, back lighting is provided by radiating light through the back lit portions 6130 of the mirror platform 6102. As noted above, the back lit portions 6130 include translucent areas having substantially no reflectivity or could be partially reflective. The low reflectivity allows light from the light source 6122 to pass through the mirror, illuminating the back lit portions 6130 of the mirror platform 6102. The number and shape of the back lit portions 6130 can be varied to provide desired visual effects.

The media display device 6120 is mounted within the mirror/media display device assembly 6100 so that the screen of the media display device 6120 aligns with the media display device viewing area 6128 of the mirror platform 6102. The term "media display device" should be understood to include any media display device suitable for receiving television signals, computer signals, VGA connections, digital signals, etc., and displaying a corresponding image.

The media display device 6120 includes a well-known indicator light 6136 and infrared sensor 6138. The indicator light 6136 provides a signal indicating whether the media display device is "powered on" or "powered off." The infrared sensor 6138 provides a remote communication port with the media display device 6120. The indicator light 6136

Figure 7:
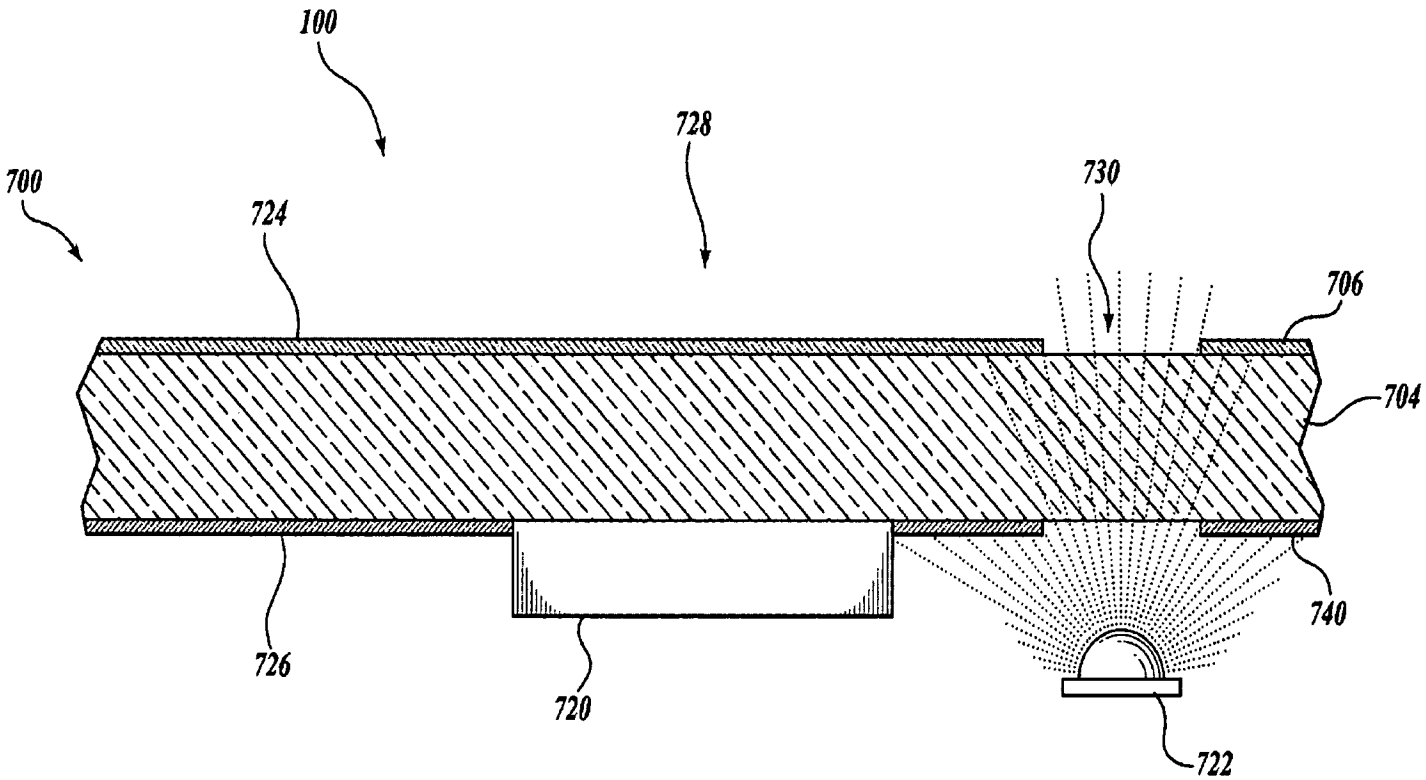
FIG. 7 is a cross-sectional view of a mirror/media display device assembly constructed in accordance with a fourth embodiment of the present disclosure.

FIG. 7 illustrates a mirror/media display device assembly 100 having a mirror platform 700 constructed in accordance with still yet another embodiment of the present disclosure. The mirror platform [700] is substantially identical in construction, material and operation as the mirror platforms described above with the following exceptions.

The mirror platform 700 includes a glass layer 704 and a reflective layer 706. The mirror platform 700 also includes a front surface 724 and a rear surface 726. The reflective layer 706, which is not completely opaque, is affixed to one or both sides of the glass layer 704. The reflective layer 706 gives the mirror platform 700 a high reflectivity. In addition, the reflective coating imparts a low transmissivity, typically in the range of about 10% to about 25%.

The media display device 720 is a high brightness media display device, having a brightness in the range of about 500 to about 2000 nits. The low transmissivity of the mirror platform 700 prevents transmission of about 75% to 90% of the light emitted from the media display device 720. The remaining 10% to 25% of the emitted light passes through the glass layer 704 and can be viewed from the front of the mirror platform 700. Standard media display devices typically operate in a range of about 300 to 500 nits of brightness. Accordingly the brightness of the media display device 720 and the transmissivity of the mirror platform 700 can be chosen to provide a desired image brightness.

For example, a transparent mirror with a transmissivity of [25]% can be paired with a media display device having about 2000 nits of brightness, resulting in an image viewed from the front side of the mirror platform 700 with a brightness of about 500 nits.

The operating environment can also influence the selection of the transmissivity of the transparent mirror and the brightness of the media display device.

The quality of the reflection from the mirror platform 700 can be improved by applying a backing layer 740 to the rear surface 726 in locations other than the media display device viewing area 728 or a back lit portion 730. The backing layer 740 is preferably black, and may also act as a safety backing, and reduces the transmissivity of the mirror, thereby improving the quality of the reflection in those areas of the mirror to which the black backing is applied. Further, the media display device 720 has a generally black screen when turned off, increasing the reflectiveness of the mirror in the media display device viewing area 728. As a result, the quality of the reflection in the media display device viewing area is improved when the media display device is in a "off" state.

The mirror platform 700 may also include one or more back lit portions 730. The back lit portion 730 is formed by selectively removing the reflective layer 706 from the glass layer 704. Sandblasting is preferably used, but any suitable method can be used, including chemical etching, chemical bath, or abrasion. The back lit portions 730 are at least partially translucent and allow more light to pass through than do the portions of the mirror platform 700 from which the reflective coating has not been selectively removed. As a result, light from a light source 722 located behind the mirror platform 700 passes through the glass layer 704, illuminating the back lit portion 730.

Figure 9:
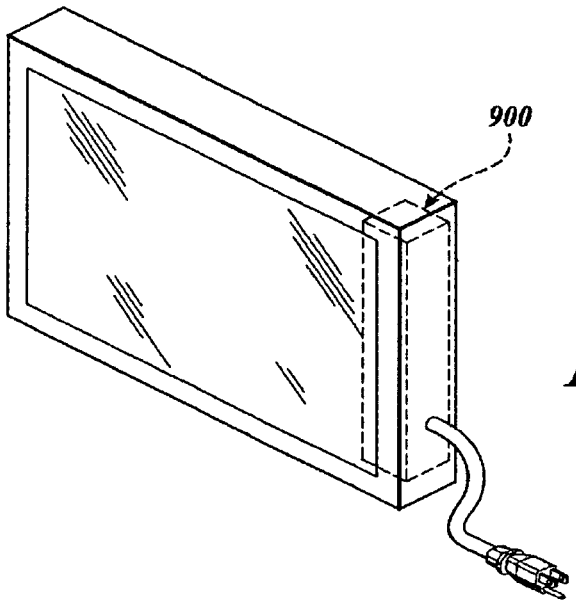
FIG. 9 is an isometric view of the media display device of a mirror/media display device assembly, showing the media display device having power adapter constructed in accordance with one embodiment of the present disclosure.

As may be best seen by referring to FIG. 9, it is preferred that the media display device 120 has a thin profile, such as about one inch or less. Such a thin profile minimizes the distance that the mirror/media display device assembly 100 extends from a wall to which it is mounted. In general, the overall thickness of the mirror/media display device assembly 100 is less than about two and one-quarter inches and, in some embodiments, as thin as one and one-quarter inches, or less.

To assist in achieving the desired thin profile, the media display device 120 is configured so that audio and visual connection components (such as the audio wire, RF cable, S-video cable, power cable) come directly out the top or in some cases, the bottom of the housing of the media display device 120 rather than from the rear of the media display device 120. To further decrease the space required to house the media display device 120, the disclosed media display device has an integral, low-profile power adapter 900 that fits within the thin (e.g., one inch) media display device housing.

Figure 8:
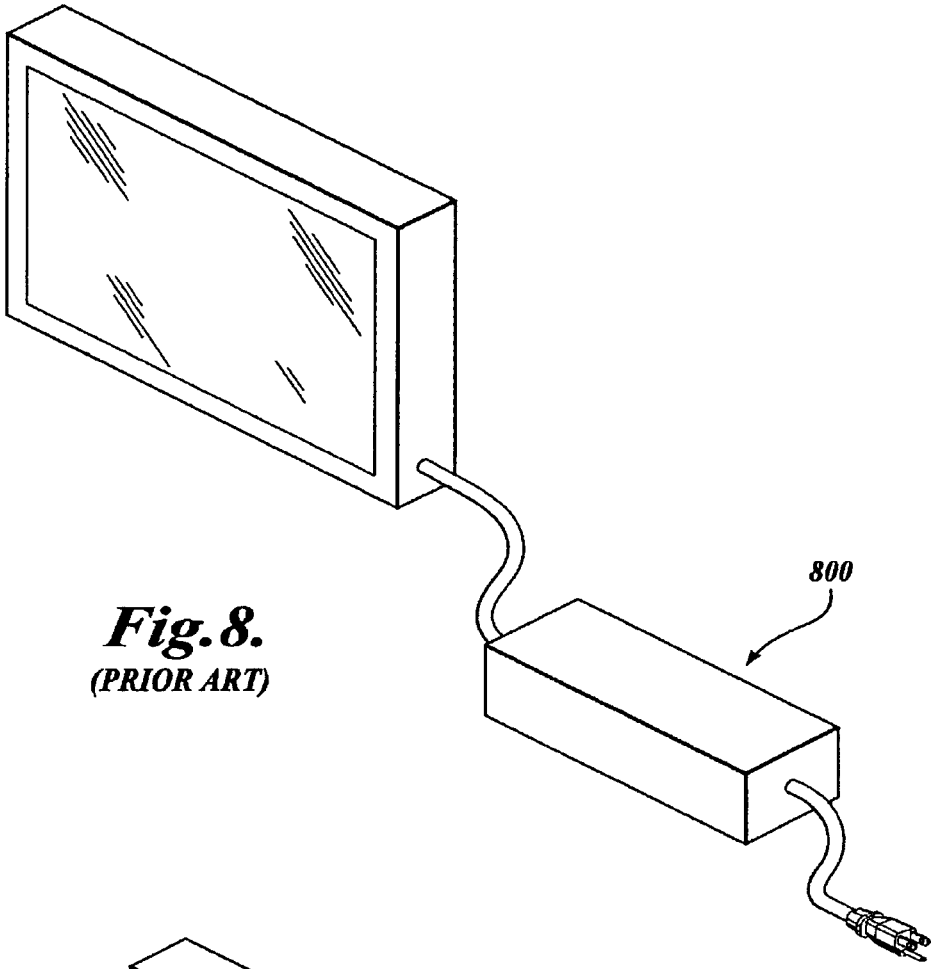
Fig. 8. (PRIOR ART)
FIG. 8 is an isometric view of a previously known media display device with an external power adapter.

As illustrated in FIG. 8, known media display device units that areless than two inches in thickness have large, external power adapters 800 that take up considerable space. The added thickness of the power adapter 800 often requires a wall recess behind the mirror/media display device assembly. FIG. 9 illustrates an integral, low-profile power adapter 900 constructed in accordance with one embodiment of the present disclosure. The power adapter 900 is contained in the housing of a media display device 120. One example of a suitable low-profile power adapter is Model No. TR36A -12, manufactured by Cincon Electronics Co. LTD. Making the low-profile power adapter 900 integral to the media display device also simplifies assembly by reducing the number of parts to be assembled.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. A medicine cabinet door assembly apparatus comprising:

a first mirror platform, the first mirror platform has a layer of non-polarized glass which is continuous across the viewable area the mirror platform, having a first portion and a second portion. the first portion has a first reflectivity and the second portion has a second reflectivity. the first reflectivity is greater than the second reflectivity a media display device, the media display device is disposed behind the second portion, a reflectivity of the second portion is selected to closely match the reflectivity of the first portion when the media display device is in an off state wherein the second portion blends into the first portion, when the media display device is in an on state information displayed on the media display device is visible within the second portion when the media display device is viewed from in front of the first mirror platform; and a mounting platform, the mounting platform is coupled to a back of the first mirror platform, the mounting platform encloses the media display device to form the medicine cabinet door assembly.

2. The apparatus of claim 1 further comprising a light source, the light source is disposed behind the first mirror platform and light from the light source can pass through a third portion in the first mirror platform to illuminate a user when the user is in front of the first mirror platform.

3. The apparatus of claim 2, wherein the light source is selected from the group consisting of a light emitting diode (LED), a fluorescent lamp, and a light emitting film.

4. The apparatus of claim 1, wherein a display screen of the media display device is separated from the media display device.

5. The apparatus of claim 4, wherein the display screen is mounted within the door assembly and at least a part of the media display device components is located outside of the door assembly.

6. The apparatus of claim 5, wherein a TV tuner is located outside of the door assembly.

7. The apparatus of claim 2, wherein a reflectivity of the third portion is changed by elimination of a backing layer from the first mirror platform over the third portion.

8. The apparatus of claim 7, wherein the media display device can receive a signal selected from the group consisting of a television signal, a computer signal, and a digital signal and then display an image using the signal.

9. The apparatus of claim 8, wherein the media display device is connected to a network.

10. The apparatus of claim 1, further comprising:

an electrical ballast, the electrical ballast is mounted outside of the door assembly.

11. The apparatus of claim 1, further comprising:

a cabinet assembly, the cabinet assembly is hingedly coupled to the door assembly, the cabinet assembly further including an opening to receive an electrical outlet.

12. The apparatus of claim 2, wherein the third portion has a general shape.

13. The apparatus of claim 12, wherein the third portion is further comprised of a first and a second substantially straight portions, wherein the first substantially straight portion extends on a right side of the mirror platform and the second substantially straight portion extends on a left side of the mirror platform.

14. The apparatus of claim 12, wherein the third portion extends around a perimeter of the first mirror platform.

15. The apparatus of claim 2, wherein the third portion has substantially no reflectivity.

16. The apparatus of claim 15, wherein a glass preparation of the third portion is selected from the group consisting of frosted glass, acid etched glass, and clear glass.

17. The apparatus of claim 1, wherein the reflectivity of the second portion is selected to allow the second portion to appears black when the media display device is in an off state.

18. The apparatus of claim 1, wherein the second portion is partially reflective when the media display device is turned off.

19. An apparatus comprising:

a first mirror platform, the first mirror platform having a first portion and a second portion, the second mirror portion is both reflective and transmissive;

a media display device, the media display device is disposed behind the first mirror platform, such that within the second portion information displayed on the media display device is visible when the media display device is on and is viewed from in front of the first mirror platform;

a mounting platform, the mounting platform is coupled to a back of the first mirror platform, the mounting platform encloses the media display device to form a door assembly; and a second mirror platform, the second mirror platform is coupled to a back of the mounting platform, wherein the door assembly provides a reflection to the user from either a front side or a back side of the door assembly; the second mirror platform has an opening which defines an electrical passageway with an opening in the mounting platform for wires to pass through.

20. The apparatus of claim 19, wherein the electrical passageway is located near a hinge of the door assembly.

21. A method comprising:

partitioning a surface area of a first mirror platform into two portions, a first portion and a second portion, the first portion has a first reflectivity and the second portion has a second reflectivity, the second portion is partially transmissive, wherein the first reflectivity is greater than the second reflectivity, the first mirror platform is made of a continuous layer of non-polarized glass; and enclosing a display screen of a media display device between the first mirror platform and a mounting platform to form a door assembly of a medicine cabinet, wherein the media display device is disposed behind the second portion, the second reflectivity is selected to closely match the first reflectivity when the media display device is in an off state wherein the second portion blends into the first portion presenting the appearance of a mirror with uniform reflectivity, when the media display device is in an on state information displayed on the media display device is visible within the second portion when the media display device is viewed from in front of the first mirror platform.

22. The method of claim 21, wherein the partitioning further comprises a third portion having a third reflectivity. and the third reflectivity is less than or equal to the second reflectivity.

23. The method of claim 21, wherein the enclosing further comprises a light source, the light source provides a source of light from inside the door assembly, wherein light from the source of light can pass through the third portion and illuminate a user when the user is in front of the first mirror platform.

24. The method of claim 21, further comprising:

combining a second mirror platform to a back side of the mounting platform.

25. The method of claim 21, wherein the mounting platform is a second mirror platform.

26. The method of claim 24, further comprising configuring a cabinet assembly to be hingedly coupled with the door assembly.

27. The method of claim 22, further comprising:

eliminating a backing layer from the e first mirror platform over the third portion in order to achieve the third reflectivity.

28. An apparatus comprising:

a first mirror platform, the first mirror platform has a layer of glass which is continuous across the viewable area the mirror platform, the first mirror platform has a first portion, a second portion, and a third portion, the first portion has a first reflectivity and the second portion has a second reflectivity, the first reflectivity is greater than the second reflectivity:

a light source, the light source is disposed behind the first mirror platform, light from the light source can pass through the third portion to illuminate a user when the user is in front of the first mirror platform wherein the user's reflection is visible in the first portion; and a mounting platform, the mounting platform is coupled to a back of the first mirror platform to form a door assembly of a medicine cabinet.

29. The apparatus of claim 28, further comprising:

a media display device, the media display device is disposed behind a the second portion of the first mirror platform, such that within the second portion information displayed on the media display device, when the media display device is on, is visible from the front of the first mirror platform.

30. The apparatus of claim 28, wherein the light source is selected from the group consisting of a light emitting diode (LED), a fluorescent lamp, and a light emitting film.

31. The apparatus of claim 28, wherein the third portion is further comprised of a first and a second substantially straight portions, wherein the first substantially straight portion extends along a right side of the first mirror platform and the second substantially straight portion extends along a left side of the first mirror platform.

32. The apparatus of claim 28, wherein the third portion extends around a perimeter of the first mirror platform.

33. The apparatus of claim 28, wherein the third portion has substantially no reflectivity.

34. The apparatus of claim 33, wherein a glass preparation of the third portion is selected from the group consisting of frosted glass, acid etched glass, and clear glass.

35. The apparatus of claim 28 wherein the light source is offset from the third portion.

* * * * *